US010625983B2

(12) United States Patent
Yamamoto

(10) Patent No.: US 10,625,983 B2
(45) Date of Patent: Apr. 21, 2020

(54) LANDING JAMB FOR ELEVATOR

(71) Applicant: MITSUBISHI ELECTRIC CORPORATION, Chiyoda-ku (JP)

(72) Inventor: Keigo Yamamoto, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 17 days.

(21) Appl. No.: 15/740,415

(22) PCT Filed: Aug. 28, 2015

(86) PCT No.: PCT/JP2015/074466
§ 371 (c)(1),
(2) Date: Dec. 28, 2017

(87) PCT Pub. No.: WO2017/037786
PCT Pub. Date: Mar. 9, 2017

(65) Prior Publication Data

US 2018/0194596 A1 Jul. 12, 2018

(51) Int. Cl.
*B66B 13/30* (2006.01)

(52) U.S. Cl.
CPC ..... *B66B 13/306* (2013.01)

(58) Field of Classification Search
CPC ..... B66B 13/30; B66B 13/301; B66B 13/308; F16B 2001/0078; F16B 5/0241
See application file for complete search history.

(56) References Cited

U.S. PATENT DOCUMENTS 2,148,310 A * 2/1939 Talen ..... B66B 13/301 16/90
5,445,244 A * 8/1995 Ketonen ..... B66B 13/306 187/325
5,904,014 A * 5/1999 Ripamonti ..... B66B 13/303 52/217
6,171,009 B1 * 1/2001 Wright ..... F16B 5/0241 403/30

(Continued)

FOREIGN PATENT DOCUMENTS

JP 2-239088 A 9/1990
JP 2004-338940 A 12/2004

(Continued)

OTHER PUBLICATIONS

International Search Report dated Dec. 1, 2015 in PCT/JP2015/074466 filed Aug. 28, 2015.

*Primary Examiner* — Minh Truong
(74) *Attorney, Agent, or Firm* — Xsensus LLP

(57) ABSTRACT

A landing jamb including a jamb main body having surfaces on which a design plate being flat plate having a larger plate thickness than a plate thickness of the jamb main body is superposed. The design plate is fixed to the jamb main body by a plurality of sets of fixtures. Each of the fixtures of at least one set of fixtures includes a stud bolt, a main nut screwed over the stud bolt, and an intermediate member through which the stud bolt is caused to pass, and which is interposed between the main nut and the jamb main body. A melting point of a material used to form the intermediate member is lower than a melting point of a material used to form the stud bolt and a melting point of a material used to form the main nut.

17 Claims, 4 Drawing Sheets

(56) References Cited

U.S. PATENT DOCUMENTS

| | | | | |
|---|---|---|---|---|
| 2005/0098388 | A1 | 5/2005 | Studhalter | |
| 2014/0003880 | A1* | 1/2014 | Grooms, II | F16B 35/00<br>411/378 |
| 2018/0216644 | A1* | 8/2018 | Mateo | B64F 5/10 |

FOREIGN PATENT DOCUMENTS

| | | | |
|---|---|---|---|
| JP | 2009-190806 | A | 8/2009 |
| JP | 2010-137957 | A | 6/2010 |
| JP | 2012-171697 | A | 9/2012 |

* cited by examiner

LANDING JAMB FOR ELEVATOR

TECHNICAL FIELD

The present invention relates to a landing jamb for an elevator, which is provided on both of right and left sides and to an upper part of a landing doorway.

BACKGROUND ART

In a related-art elevator hoistway closure apparatus, a closure-side door frame includes a first door frame component and a second door frame component. The first door frame component and the second door frame component are fixed to a vertical base member of a building. The first door frame component is connected to the second door frame component so as to be thermally separable from the second door frame component. When fire occurs, the first door frame component is thermally deformed so as to separate from the second door frame component. As a result, the second door frame component is protected from direct heat radiation (see, for example, Patent Literature 1).

Further, in a related-art elevator landing apparatus, a thermally deformable buffer member is interposed between a door hanger and a landing door panel. The thermally deformable buffer member is made of a material whose Young's modulus becomes equal to or smaller than 20 GPa when fire occurs. Even in a case where the landing door panel thermally expands at the time of occurrence of fire, the thermally deformable buffer member which softens at a high temperature absorbs extension of the landing door panel to prevent occurrence of warpage of the landing door panel (see, for example, Patent Literature 2).

CITATION LIST

Patent Literature

[PTL 1] JP 2004-338940 A
[PTL 2] JP 2009-190806 A

SUMMARY OF THE INVENTION

Problem to be Solved by the Invention

With a structure of the related-art elevator hoistway closure apparatus disclosed in Patent Literature 1, when a higher-class design is desired for a periphery of a landing doorway, a design of a whole jamb is required to be changed, with the result that cost is disadvantageously increased. Meanwhile, when a design panel made of a different material is merely bonded to a jamb main body, there is a fear in that the design panel falls to a landing side in the event of separation of the design panel due to aging degradation of an adhesive or the like. Further, when the design panel is fixed to the jamb main body with stud bolts, a force for warping the design panel is generated due to a difference in coefficient of thermal expansion and a difference in plate thickness at the time of occurrence of fire. When the jamb main body is stretched and deformed by the force, a gap is formed between the landing and a hoistway. As a result, there is a fear in that fire protection performance is degraded.

In the landing apparatus disclosed in Patent Literature 2, the extension of the landing door panel is absorbed by the thermally deformable buffer member at the time of occurrence of fire. However, there is no suggestion about providing the design panel to the jamb and about the occurrence of the warpage in the design panel.

The present invention has been made to solve the problem described above, and has an object to obtain a landing jamb for an elevator, which is capable of preventing degradation of fire protection performance while improving design quality.

Means for Solving the Problem

According to one embodiment of the present invention, there is provided a landing jamb for an elevator, including: a jamb main body provided to both sides of a landing doorway and to an upper part of the landing doorway; a design plate superposed to surfaces of the jamb main body, the design plate being a flat plate having a plate thickness larger than a plate thickness of the jamb main body; and a plurality of sets of fixtures configured to fix the design plates to the jamb main body, in which each of the fixtures of at least one set of the plurality of sets of fixtures includes: a stud bolt, which is fixed to corresponding one of the design plate, and passes through the jamb main body; a main nut screwed over the stud bolt; and an intermediate member through which the stud bolt is caused to pass, and which is interposed between the main nut and the jamb main body, and in which a melting point of a material used to form the intermediate member is lower than a melting point of a material used to form the stud bolt and a melting point of a material used to form the main nut.

Effects of the Invention

In the landing jamb for an elevator according to the present invention, the melting point of the intermediate member arranged between the main nut and the jamb main body is lower than the melting point of the stud bolt and the melting point of the main nut. Therefore, at the time of occurrence of fire, the intermediate member melts to allow displacement of the design panel from the jamb main body. Thus, a force for stretching the jamb main body, which is generated due to warpage of the design plate, can be reduced to prevent deformation of the jamb main body. As a result, the degradation of fire protection performance can be prevented while improving the design quality.

DESCRIPTION OF EMBODIMENTS

Now, a mode for carrying out the present invention is described with reference to the drawings.

First Embodiment

Figure 1:
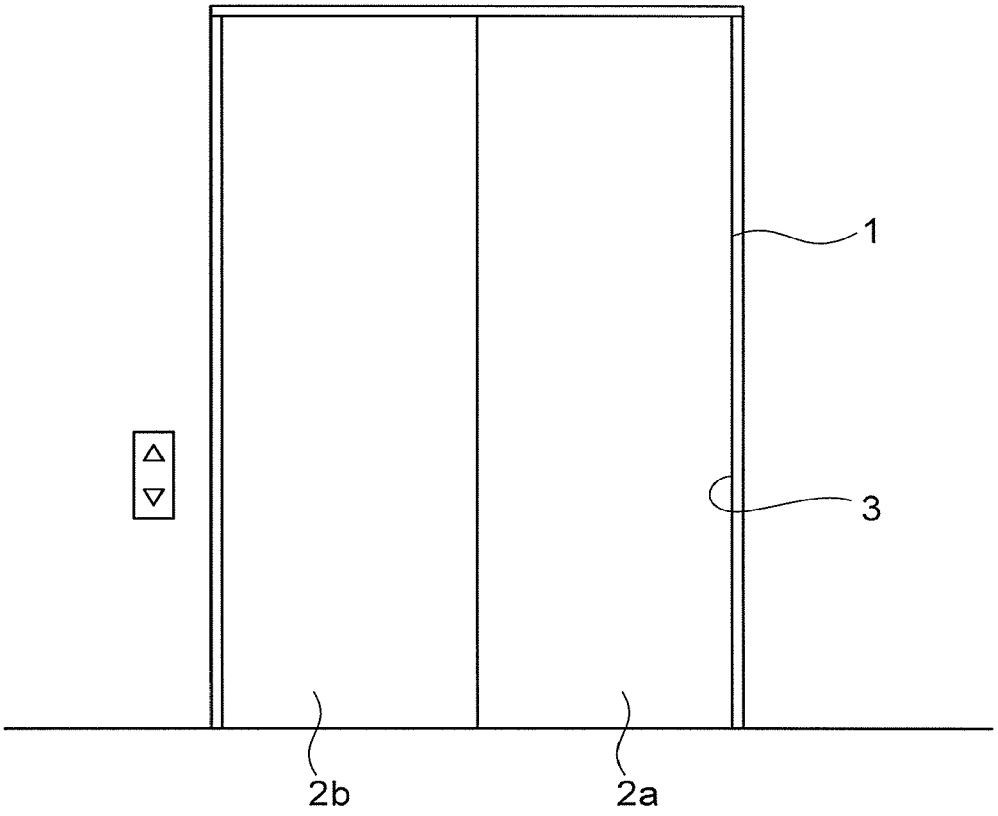
FIG. 1 is a front view for illustrating a landing for an elevator of a first embodiment of the present invention.

FIG. 1 is a front view for illustrating a landing for an elevator of a first embodiment of the present invention. In FIG. 1, a landing doorway 1 is provided in the landing. The landing doorway 1 is opened and closed by a pair of landing doors 2*a* and 2*b*. A landing jamb 3 is provided on both sides of the landing doorway 1 in a width direction of the landing doorway 1 and to an upper part of the landing doorway 1.

Figure 2:
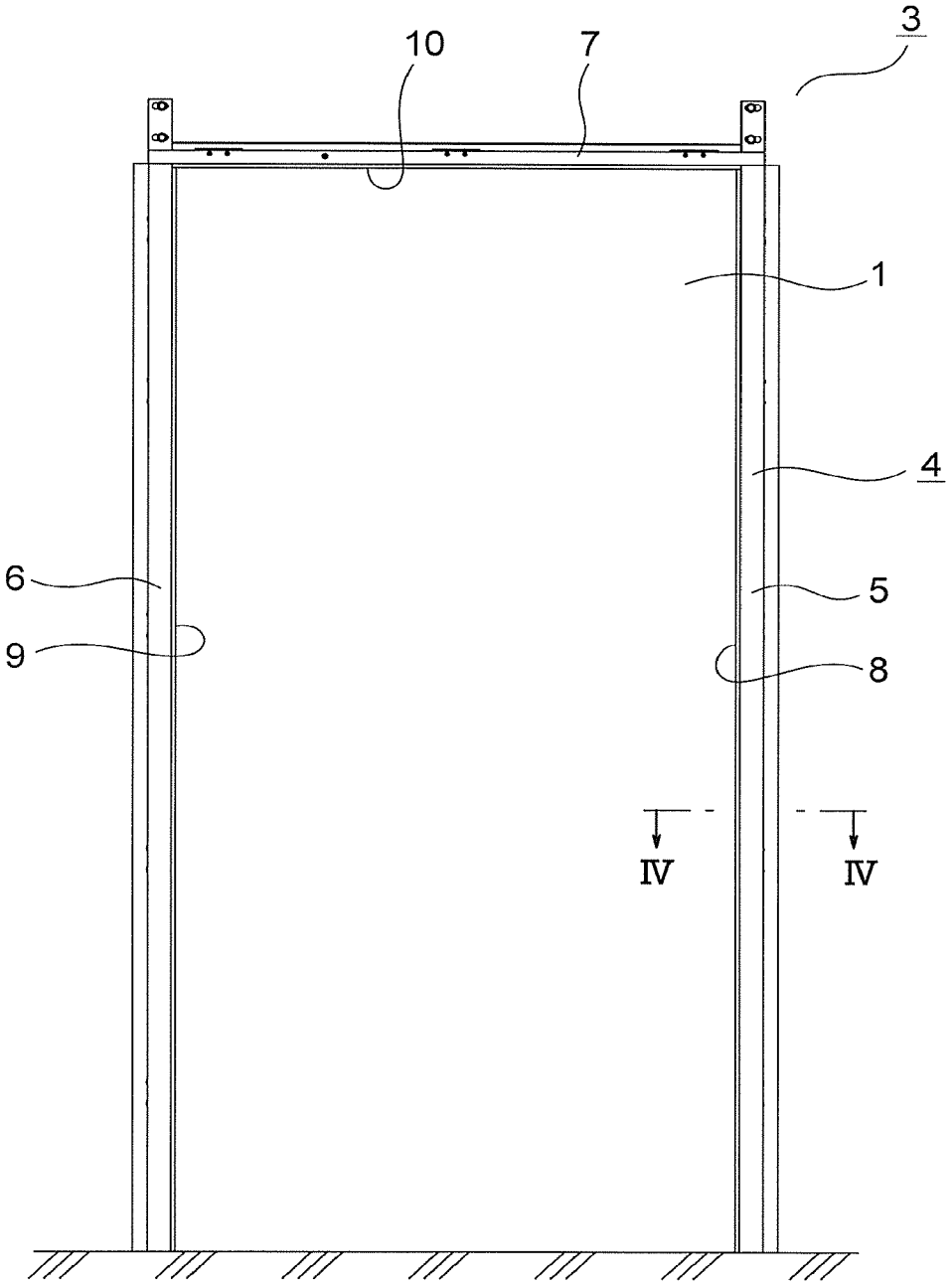
FIG. 2 is a front view for illustrating a landing jamb illustrated in FIG. 1.

FIG. 2 is a front view for illustrating the landing jamb 3 illustrated in FIG. 1. A jamb main body 4 having a gate-like shape includes a first vertical frame 5 fixed to one side of the landing doorway 1 in the width direction, a second vertical frame 6 fixed to another side of the landing doorway 1 in the width direction, and a top frame 7 fixed between an upper end portion of the first vertical frame 5 and an upper end portion of the second vertical frame 6. Each of the vertical frames 5 and 6 and the top frame 7 is formed by bending a steel plate.

A first flat bar 8 as a design plate is superposed and fixed to a surface of the first vertical frame 5, which faces the landing doorway 1. A second flat bar 9 as a design plate is superposed and fixed to a surface of the second vertical frame 6, which faces the landing doorway 1. A third flat bar 10 as a design plate is superposed and fixed to a surface of the top frame 7, which faces the landing doorway 1, specifically, to a lower surface of the top frame 7.

Each of the flat bars 8, 9, and 10 is formed of a stainless-steel plate. Further, a plate thickness of each of the flat bars 8, 9, and 10 is larger than a plate thickness of the steel plates which form the jamb main body 4. FIG. 2 is an illustration of a state in which the landing jamb 3 is being installed, and hence the jamb main body 4 and the flat bars 8, 9, and 10 are exposed to an outside. After the installation, however, the jamb main body 4 is covered with a surface material of a landing wall so that only the flat bars 8, 9, and 10 are exposed on the landing side.

Figure 3:
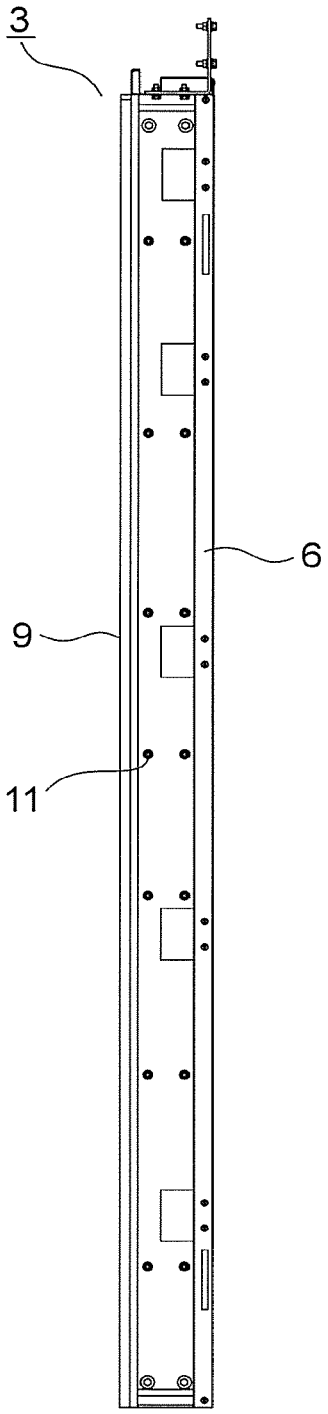
FIG. 3 is a left side view for illustrating the landing jamb illustrated in FIG. 2.

FIG. 3 is a left side view for illustrating the landing jamb 3 illustrated in FIG. 2. The second flat bar 9 is fixed to the second vertical frame 6 with a plurality of sets of fixtures 11. The fixtures 11 are arranged at intervals in a width direction and in a vertical direction of the second flat bar 9. The first flat bar 8 is fixed to the first vertical frame 5 and the third flat bar 10 is fixed to the top frame 7 by the similar fixtures 11.

The landing jamb 3 includes the jamb main body 4, the flat bars 8, 9, and 10, and the fixtures 11.

Figure 4:
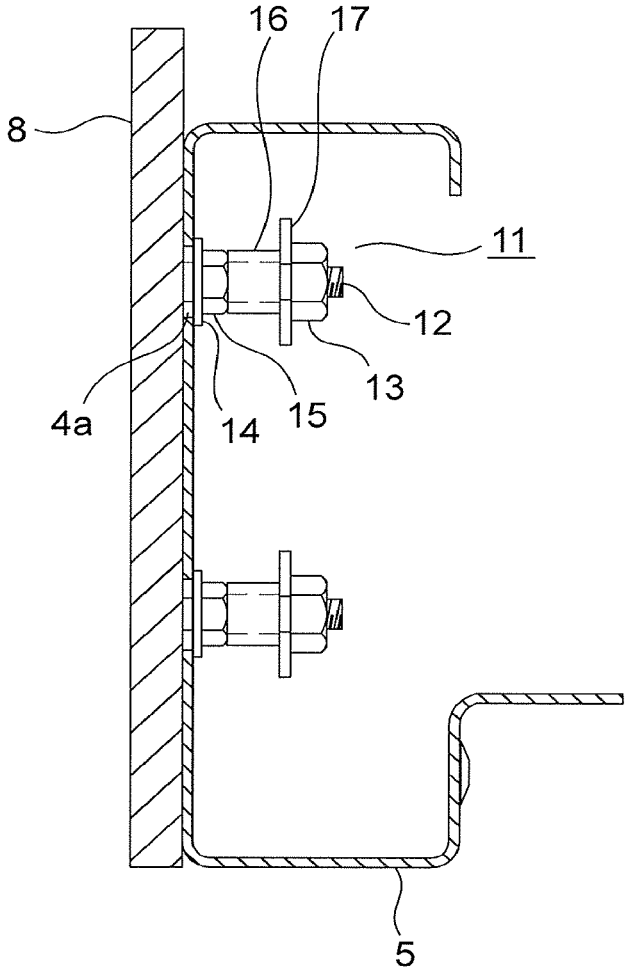
FIG. 4 is a sectional view taken along the line IV-IV of FIG. 2.

FIG. 4 is a sectional view taken along the line IV-IV of FIG. 2. Each of the fixtures 11 includes a stud bolt 12, a main nut 13, a small-diameter washer 14, an auxiliary nut 15, a spacer 16, and a closure washer 17.

Each of the stud bolts 12 is fixed at a right angle onto a surface of the first flat bar 8, which is on a side opposite to the landing doorway 1. Further, each of the stud bolts 12 passes through the jamb main body 4. A plurality of through holes 4*a* which allow the stud bolts 12 to pass therethrough are formed in the jamb main body 4.

The main nut 13 is screwed over the stud bolt 12. The stud bolt 12 is caused to pass through the small-diameter washer 14, the auxiliary nut 15, the spacer 16, and the closure washer 17. The small-diameter washer 14, the auxiliary nut 15, the spacer 16, and the closure washer 17 are interposed between the main nut 13 and the first vertical frame 5.

The closure washer 17 is arranged on a side of the main nut 13, which is closer to the first flat bar 8. An outer diameter of the closure washer 17 is larger than a diameter of the through hole 4*a*. The stud bolt 12 and the main nut 13 are both made of steel.

The closure washer 17 is made of the same material as at least any one of a material used to form the stud bolt 12 and a material used to form the main nut 13. In this example, the stud bolt 12 and the main nut 13 are made of steel. Therefore, the closure washer 17 is also made of steel.

The small-diameter washer 14 is held in contact with a peripheral edge portion of the through hole 4*a* and is interposed between the auxiliary nut 15 and the first vertical frame 5. An outer diameter of the small-diameter washer 14 is larger than a diameter of the through hole 4*a* and is smaller than the outer diameter of the closure washer 17. The auxiliary nut 15 is screwed over the stud bolt 12.

The spacer 16 has a cylindrical shape and is interposed between the closure washer 17 and the auxiliary nut 15. The small-diameter washer 14, the auxiliary nut 15, and the spacer 16 are all made of aluminum or an aluminum alloy.

Therefore, a melting point of the material which is used to form the small-diameter washer 14, the auxiliary nut 15, and the spacer 16 is lower than a melting point of the material which is used to form the stud bolt 12, the main nut 13, and the closure washer 17. Specifically, the small-diameter washer 14, the auxiliary nut 15, and the spacer 16 are intermediate members in the first embodiment.

In this example, the melting point of the material which is used to form the stud bolt 12, the main nut 13, and the closure member 17 is 1,100° C. or higher, whereas the melting point of the material which is used to form the small-diameter washer 14, the auxiliary nut 15, and the spacer 16 is lower than 700° C.

The fixtures 11 configured to fix the second flat bar 9 to the second vertical frame 6 and the fixtures 11 configured to fix the third flat bar 10 to the top frame 7 are also constructed as illustrated in FIG. 4.

In the landing jamb 3 for an elevator described above, the flat bars 8, 9, and 10 are superposed to the jamb main body 4. Therefore, design quality can be improved.

Further, the melting point of the small-diameter washer 14, the auxiliary nut 15, and the spacer 16, which are arranged between the main nut 13 and the jamb main body 4, is lower than the melting point of the stud bolt 12 and the main nut 13. Therefore, at the time of occurrence of fire, the small-diameter washer 14, the auxiliary nut 15, and the spacer 16 melt to allow displacement of the flat bars 8, 9, and 10 from the jamb main body 4.

Therefore, a force for stretching the jamb main body 4 due to warpage of the flat bars 8, 9, and 10 can be reduced to prevent deformation of the jamb main body 4. Thus, degradation of fire protection performance can be prevented while improving the design quality.

Further, the flat bar 8, 9, and 10 are superposed to the surfaces of the jamb main body 4, which face the landing doorway 1. Therefore, the design quality of the landing doorway 1 can be sufficiently improved.

Further, when the small-diameter washer 14, the auxiliary nut 15, and the spacer 16 melt to warp the flat bars 8, 9, and 10, the through hole 4*a* can be closed as a result of the contact of the closure washer 17 with the peripheral edge portion of the through hole 4*a*. Therefore, the degradation of fire protection performance can be more reliably prevented.

Still further, the melting point of the material which is used to form the stud bolt 12, the main nut 13, and the closure member 17 is 1,100° C. or higher, whereas the melting point of the material which is used to form the small-diameter washer 14, the auxiliary nut 15, and the spacer 16 is lower than 700° C. Therefore, separation of the flat bars 8, 9, and 10 from the jamb main body 4 can be more reliably prevented while the small-diameter washer 14, the auxiliary nut 15, and the spacer 16 melt under a high temperature at the time of occurrence of fire.

Further, the spacer 16 simply having the cylindrical shape is added as the intermediate member. Therefore, a sufficient allowance for the warpage of the flat bars 8, 9, and 10 can be ensured, while the allowance can be easily adjusted.

Although the flat bars 8, 9, and 10 are arranged on the entire surfaces of the jamb main body 4, which face the landing doorway 1 in the example described above, the design plates may be partially arranged on the jamb main body. Further, the design plates may be arranged on surfaces of the jamb main body, which face the landing.

Further, the material of the intermediate members is not limited to aluminum or the aluminum alloy. As long as a material melts under a high temperature caused by fire, for example, a copper alloy, a magnesium alloy, a zinc alloy, a solder, a flame-retardant plastic, or the like may be used.

Further, the material of the stud bolt, the main nut, and the closure washer is not limited to iron. As long as a sufficient fire resistance can be maintained even under the high temperature caused by fire, other materials may be used.

Still further, in the example described above, the small-diameter washer 14, the auxiliary nut 15, and the spacer 16 are described as the intermediate members. However, a type and the number of the intermediate members are not limited to those described above, and may be appropriately increased or omitted.

Still further, it is not always required that all the intermediate members be made of the same material. Similarly, it is not always required that the stud bolt, the main nut, and the closure washer be made of the same material.

Still further, the fixtures 11 are not required to be used at all fixing portions between the jamb main body 4 and the flat bars 8, 9, and 10. The fixtures 11 may be used only for at least one of the fixing portions. For example, for a plurality of fixing portions between the first vertical frame 5 and the flat bar 8, an uppermost portion in a height direction of the first vertical frame 5 and the flat bar 8 may be fixed only with the stud bolt, the main nut, and the closure washer without using the intermediate members, whereas the fixing portions other than the uppermost portion may be fixed using the fixtures 11.

The invention claimed is:

1. A landing jamb for an elevator, comprising:

a jamb main body provided on both sides of a landing doorway and to an upper part of the landing doorway;

a design plate superposed to a surface of the jamb main body, the design plate being a flat plate having a plate thickness larger than a plate thickness of the jamb main body, the design plate facing a center of the landing doorway which is an opening of the landing jamb; and a plurality of sets of fixtures configured to fix the design plate to the jamb main body, wherein each of the fixtures of at least one set of the plurality of sets of fixtures includes:

a stud bolt, which is fixed to the design plate, and passes through the jamb main body;

a main nut screwed over the stud bolt; and an intermediate member through which the stud bolt is caused to pass, and which is interposed between the main nut and the jamb main body, the intermediate member comprising a spacer and an auxiliary nut, wherein a melting point of a material used to form the intermediate member is lower than a melting point of a material used to form the stud bolt and a melting point of a material used to form the main nut, and wherein an axis parallel to a length of the stud bolt intersects the center of the landing doorway.

2. The landing jamb for an elevator according to claim 1, wherein the design plate is superposed to surfaces of the jamb main body, which face the landing doorway.

3. The landing jamb for an elevator according to claim 2, wherein the jamb main body includes a plurality of through holes through which the stud bolts are allowed to pass, wherein the each fixture of the at least one set of fixtures further includes a closure washer through which the stud bolt is caused to pass, wherein the closure washer is made of a same material as at least any one of the material used to form the stud bolt and the material used to form the main nut, and wherein the closure washer has an outer diameter larger than a diameter of each of the plurality of through holes.

4. The landing jamb for an elevator according to claim 3, wherein the material used to form the main nut is same as the material used to form the stud bolt.

5. The landing jamb for an elevator according to claim 4, wherein the melting point of the material used to form the stud bolt and the melting point of the material used to form the main nut are 1,000° C. or higher, and wherein the melting point of the material used to form the intermediate member is lower than 800° C.

6. The landing jamb for an elevator according to claim 3, wherein the melting point of the material used to form the stud bolt and the melting point of the material used to form the main nut are 1,000° C. or higher, and wherein the melting point of the material used to form the intermediate member is lower than 800° C.

7. The landing jamb for an elevator according to claim 2, wherein the material used to form the main nut is same as the material used to form the stud bolt.

8. The landing jamb for an elevator according to claim 7, wherein the melting point of the material used to form the stud bolt and the melting point of the material used to form the main nut are 1,000° C. or higher, and wherein the melting point of the material used to form the intermediate member is lower than 800° C.

9. The landing jamb for an elevator according to claim 2, wherein the melting point of the material used to form the stud bolt and the melting point of the material used to form the main nut are 1,000° C. or higher, and wherein the melting point of the material used to form the intermediate member is lower than 800° C.

10. The landing jamb for an elevator according to claim 1, wherein the jamb main body includes a plurality of through holes through which the stud bolts are allowed to pass, wherein the each fixture of the at least one set of fixtures further includes a closure washer through which the stud bolt is caused to pass, wherein the closure washer is made of a same material as at least any one of the material used to form the stud bolt and the material used to form the main nut, and wherein the closure washer has an outer diameter larger than a diameter of each of the plurality of through holes.

11. The landing jamb for an elevator according to claim 10, wherein the material used to form the main nut is same as the material used to form the stud bolt.

12. The landing jamb for an elevator according to claim 11, wherein the melting point of the material used to form the stud bolt and the melting point of the material used to form the main nut are 1,000° C. or higher, and wherein the melting point of the material used to form the intermediate member is lower than 800° C.

13. The landing jamb for an elevator according to claim 10, wherein the melting point of the material used to form the stud bolt and the melting point of the material used to form the main nut are 1,000° C. or higher, and wherein the melting point of the material used to form the intermediate member is lower than 800° C.

14. The landing jamb for an elevator according to claim 1, wherein the material used to form the main nut is same as the material used to form the stud bolt.

15. The landing jamb for an elevator according to claim 14, wherein the melting point of the material used to form the stud bolt and the melting point of the material used to form the main nut are 1,000° C. or higher, and wherein the melting point of the material used to form the intermediate member is lower than 800° C.

16. The landing jamb for an elevator according to claim 1, wherein the melting point of the material used to form the stud bolt and the melting point of the material used to form the main nut are 1,000° C. or higher, and wherein the melting point of the material used to form the intermediate member is lower than 800° C.

17. The landing jamb for an elevator according to claim 1, wherein:

design plate is a closest part of the landing jamb to a center of the landing doorway.

* * * * *